US010370919B2

(12) United States Patent
Hansen et al.

(10) Patent No.: US 10,370,919 B2
(45) Date of Patent: Aug. 6, 2019

(54) MULTIFUNCTION WELLBORE TUBULAR PENETRATION TOOL

(71) Applicant: AARBAKKE INNOVATION A.S., Bryne (NO)

(72) Inventors: Henning Hansen, Dolores (ES); Tarald Gudmestad, Naerbo (NO); Reid Skjaerpe, Naerbo (NO); Sjur Usken, Sandnes (NO)

(73) Assignee: AARBAKKE INNOVATION AS, Bryne (NO)

( * ) Notice: Subject to any disclaimer, the term of this patent is extended or adjusted under 35 U.S.C. 154(b) by 258 days.

(21) Appl. No.: 15/302,490

(22) PCT Filed: Jan. 28, 2015

(86) PCT No.: PCT/US2015/013191
§ 371 (c)(1),
(2) Date: Oct. 7, 2016

(87) PCT Pub. No.: WO2015/175025
PCT Pub. Date: Nov. 19, 2015

(65) Prior Publication Data

US 2017/0030157 A1 Feb. 2, 2017

Related U.S. Application Data

(60) Provisional application No. 61/994,190, filed on May 16, 2014.

(51) Int. Cl.
*E21B 29/00* (2006.01)
*E21B 23/01* (2006.01)
(Continued)

(52) U.S. Cl.
CPC ..... *E21B 29/002* (2013.01); *E21B 17/05* (2013.01); *E21B 17/1021* (2013.01);
(Continued)

(58) Field of Classification Search
CPC .... E21B 43/112; E21B 17/05; E21B 17/1021; E21B 17/1078; E21B 23/01;
(Continued)

(56) References Cited

U.S. PATENT DOCUMENTS 4,809,790 A * 3/1989 Manchak, Jr. ..... E21B 7/002 175/17
6,581,455 B1 * 6/2003 Berger ..... E21B 21/103 175/50
(Continued)

FOREIGN PATENT DOCUMENTS

EP 2085571 A2 8/2009
WO 0238343 A2 5/2002
(Continued)

OTHER PUBLICATIONS

European Patent Office, Extended European Search Report for European Application No. 15792222.0, dated Dec. 5, 2017.

*Primary Examiner* — Caroline N Butcher
(74) *Attorney, Agent, or Firm* — Richard A. Fagin

(57) ABSTRACT

A wellbore intervention tool includes a housing and a means for locking the housing at a selected position inside a first wellbore pipe. The tool includes means for penetrating the first wellbore pipe extensible from the housing. The means for penetrating includes means for measuring an amount of extension thereof or an amount of force exerted thereby such that the means for penetrating is controllable to penetrate the first wellbore pipe without penetration of a second wellbore pipe in which the first wellbore pipe is nested.

28 Claims, 11 Drawing Sheets

(51) Int. Cl.

| | |
|---|---|
| ***E21B 43/112*** | (2006.01) |
| ***E21B 17/05*** | (2006.01) |
| ***E21B 17/10*** | (2006.01) |
| ***E21B 29/02*** | (2006.01) |
| ***E21B 29/06*** | (2006.01) |
| ***E21B 33/122*** | (2006.01) |
| ***E21B 33/127*** | (2006.01) |
| ***E21B 33/13*** | (2006.01) |
| ***E21B 34/08*** | (2006.01) |
| ***E21B 43/114*** | (2006.01) |
| ***E21B 43/12*** | (2006.01) |
| ***E21B 43/14*** | (2006.01) |
| ***E21B 47/00*** | (2012.01) |
| ***E21B 47/06*** | (2012.01) |
| ***E21B 47/10*** | (2012.01) |
| ***E21B 49/08*** | (2006.01) |
| *E21B 34/06* | (2006.01) |
| *E21B 34/10* | (2006.01) |
| *E21B 47/12* | (2012.01) |

(52) U.S. Cl.
CPC ..... *E21B 17/1078* (2013.01); *E21B 23/01* (2013.01); *E21B 29/02* (2013.01); *E21B 29/06* (2013.01); *E21B 33/122* (2013.01); *E21B 33/127* (2013.01); *E21B 33/13* (2013.01); *E21B 34/08* (2013.01); *E21B 43/112* (2013.01); *E21B 43/114* (2013.01); *E21B 43/12* (2013.01); *E21B 43/14* (2013.01); *E21B 47/0002* (2013.01); *E21B 47/06* (2013.01); *E21B 47/065* (2013.01); *E21B 47/10* (2013.01); *E21B 47/101* (2013.01); *E21B 49/081* (2013.01); *E21B 34/066* (2013.01); *E21B 34/10* (2013.01); *E21B 47/123* (2013.01); *E21B 49/086* (2013.01)

(58) Field of Classification Search
CPC ..... E21B 29/002; E21B 29/02; E21B 29/06; E21B 29/33; E21B 33/122; E21B 33/127; E21B 33/13; E21B 34/066; E21B 34/08; E21B 34/10; E21B 43/114; E21B 43/12; E21B 43/14; E21B 47/0002; E21B 47/06; E21B 47/065; E21B 47/10; E21B 47/101; E21B 47/123; E21B 49/081; E21B 49/086
See application file for complete search history.

(56) References Cited

U.S. PATENT DOCUMENTS

| | | | | |
|---|---|---|---|---|
| 2003/0105175 | A1 | 6/2003 | Czaplicki et al. | |
| 2003/0196820 | A1* | 10/2003 | Patel | E21B 33/127 166/387 |
| 2009/0301720 | A1* | 12/2009 | Edwards | E21B 33/146 166/281 |
| 2012/0006547 | A1* | 1/2012 | Robertson | E21B 17/026 166/298 |
| 2012/0074110 | A1* | 3/2012 | Zediker | B08B 7/0042 219/121.72 |
| 2013/0105175 | A1* | 5/2013 | Mailand | E21B 34/06 166/373 |
| 2013/0228372 | A1* | 9/2013 | Linyaev | E21B 7/15 175/16 |
| 2014/0060852 | A1* | 3/2014 | Smith | E21B 23/04 166/373 |
| 2015/0211314 | A1* | 7/2015 | McAfee | E21B 29/005 166/250.01 |

FOREIGN PATENT DOCUMENTS

| | | | |
|---|---|---|---|
| WO | 2011058015 | A1 | 5/2011 |
| WO | 2012031009 | A1 | 3/2012 |
| WO | 2012083016 | A2 | 6/2012 |

* cited by examiner 3
2A
4D
2B
4C
4A
2E
1
2D
1A
2C
4D
4C
4B
2A
4A
1
1A
4B
1
1A
5A
5

Cut window

Deploy gripper

Position gripper

Pull in lines

MULTIFUNCTION WELLBORE TUBULAR PENETRATION TOOL

BACKGROUND

This disclosure relates to the field of penetrating one or several wellbore pipes or conduits ("tubulars") for integrity testing, reservoir testing and the like. More specifically, the present disclosure relates to a wellbore intervention tool that can penetrate through one or more tubulars disposed in a wellbore, enable performance of leakage and pressure testing, and wherein subsequent placement of sealants, inflow testing and the like can be performed.

In the hydrocarbon exploitation industry there is often a need for creating a liquid or gas communication passage through the wall of wellbore-emplaced tubulars such as a casing or a tubing. Also, penetration of wellbore-emplaced tubulars may be required to circulate fluids for cleaning the external surface of certain tubulars, followed by placing cement or other sealing material proximate the area of the penetration(s). Such penetration(s) may be in the form of one or more holes drilled through the tubular or created by detonation of an explosive shaped charge.

Penetrations through the wall of wellbore tubulars may also be used for testing for abnormal pressure buildup external to a wellbore tubular, for bleeding of any pressure built up, for injecting a sealant material, and the like. In addition, newly constructed and prior existing wellbores are frequently tested to check fluid inflow or fluid injection performance, where penetration(s) in wellbore tubulars can also be used for such operation.

Nested wellbore tubulars, such as a tubing disposed within a casing string, are normally not coaxially aligned in relation to each other in a wellbore. Typically, a wellbore tubular nested within another, larger internal diameter wellbore tubular will be in close proximity to the larger diameter tubular on one side of the wellbore. Therefore it is important for certain types of tubular penetration tools only the penetrate the tubular(s) required, and not to damage the larger diameter wellbore tubular in which the penetrated wellbore tubular is nested. Methods known in the art for penetrating a wellbore tubular based on detonating an explosive shaped charge or mechanically punching a hole in a tubular downhole lack the ability to accurately control penetration depth. Hence, such methods have a high risk of damaging the outer tubular.

In addition to above challenge with nested wellbore tubulars, where an annular space between nested wellbore tubulars is filled with cement and/or other barrier material to effect hydraulic isolation therein, the integrity of the cement between such tubulars may be questionable because of the uneven distribution of annular cross-sectional area. Uneven distribution of annular cross-sectional area may result in uneven cement velocity distribution during cement pumping, thus resulting in areas within the annular space that do not have sufficient cement to obtain useful hydraulic isolation.

Wellbore completions known in the art may have one or more relatively small diameter tubes mounted externally on a production or injection tubing. Such small diameter tubes may be used as conduits for electrical and/or fiber optic and/or hydraulic or pneumatic lines to enable, for example, control of downhole sensors, valves and related devices. Due to the likelihood of leakage of reservoir fluids or gas between, under or within such control lines, there may be a need to remove such small diameter tubes if a wellbore is to be abandoned with a tubing remaining in place.

DETAILED DESCRIPTION

Figures 1, 2, 3:
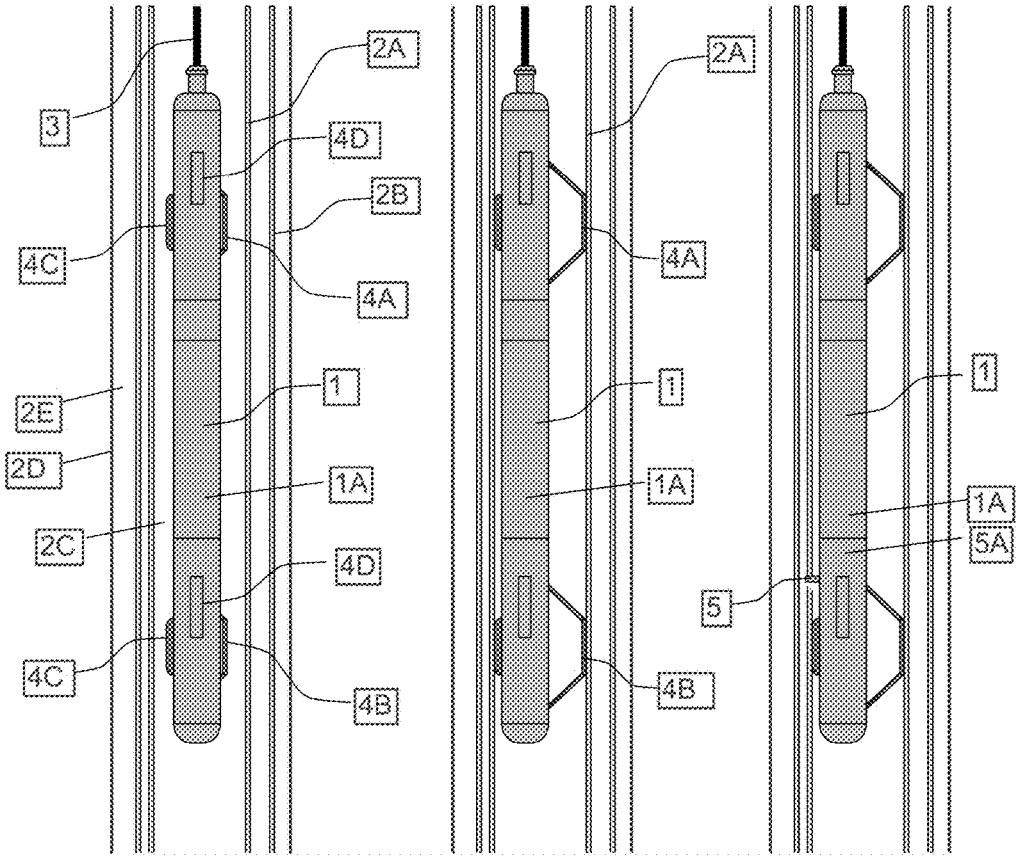
FIG. 1 illustrates a wellbore intervention tool for penetration of tubulars disposed in a wellbore having two substantially concentric tubulars disposed therein.
FIG. 2 illustrates the wellbore intervention tool of FIG. 1 with extendable arms in an extended position, pushing the tool against the tubular to be penetrated.
FIG. 3 illustrates the wellbore intervention tool of FIG. 1 with a penetration device extended out of the tool body and drilled through an internally nested wellbore tubular.

FIG. 1 illustrates an example embodiment of a wellbore intervention tool 1 for penetration of one or more conduits, pipes or "tubulars", in the present example an inner tubular such as a tubing 2A disposed or nested inside a casing 2B within a wellbore 2D. Note that the wellbore 2D may have one (e.g., the casing 2B) or more tubulars placed successively externally to the tubing 2A shown in FIG. 1. The wellbore intervention tool 1 may be deployed into the tubing 2A, powered and controlled, for example, by an armored electrical cable 3, by a semi stiff, spoolable well intervention rod incorporating one or more electrical cables, or by a coiled or jointed conduit having one or several electrical cable located externally or internally thereof. See, for example, U.S. Pat. No. 5,184,682 issued to Delacour et al. and U.S. Pat. No. 5,285,008 issued to Sas-Jaworsky et al. The manner of conveyance of the wellbore intervention tool 1 into and out of the wellbore 2C is not intended to limit the scope of the present disclosure.

In the illustrated wellbore 2D in FIG. 1, the tubing 2A is nested within the casing 2B off-center, such that there is substantial annular space 2C between the tubing 2A and the casing 2B on one side of the wellbore 2D, but on the opposed side, the casing 2B and the tubing 2A are proximate each other or are in contact with each other. An annular space 2E between the wellbore 2D and the casing 2B thus may or may not be evenly distributed around the circumference of the casing 2B or any further externally disposed tubulars (not shown).

The wellbore intervention tool 1 may include an elongated housing 1A, which may be pressure sealed to exclude fluid in the wellbore 2C from entering. The housing 1A may include components (not shown separately in FIG. 1) for operating certain devices to be explained in more detail below. The wellbore intervention tool 1 may include axially spaced apart standoffs 4C on one side of the housing 1A to hold the wellbore intervention tool 1 at a selected minimum distance from an interior wall of any tubular in which the wellbore intervention tool 1 is disposed, in the present example, the tubing 2A. At the same or at another circumferential position about the housing 1A, the wellbore intervention tool 1 may include one or more laterally extensible arms 4A, 4B. The laterally extensible arms 4A, 4B may be extended and retracted using any known mechanism, shown generally at 4D, including, for example and without limitation, hydraulic cylinders, motor operated worm gear and ball nut assemblies. Two non-limiting examples of such mechanisms are described in U.S. Pat. No. 5,438,169 issued to Kennedy et al. and U.S. Pat. No. 5,528,556 issued to Seeman et al. Control signals to extend and retract the laterally extensible arms 4A, 4B may be communicated over the electrical cable 3 or other conveyance device as explained above.

FIG. 2 illustrates the wellbore intervention tool 1 with its laterally extensible arms 4A, 4B in the extended position, wherein the housing 1A is urged to a position proximate the tubular to be penetrated, in the present example the tubing 2A. By extending the laterally extensible arms 4A, 4B and urging the wellbore intervention tool 1 proximate the tubular to be penetrated, e.g., the tubing 2A, more accurate control of penetration depth can be obtained.

FIG. 3 illustrates the wellbore intervention tool 1 with a penetration device 5 extended laterally outwardly from the housing 1A and penetration made through a first tubular, e.g., the tubing (2A in FIG. 1). The penetration device 5 may be mechanically or hydraulically extended from the housing 1A by a power module 5A. The power module 5A may comprise a motor to rotate the penetration device 5 and an extension mechanism to selectively extend the penetration device a determinable lateral distance from the housing 1A. An example of such a power module is described in U.S. Pat. No. 7,530,407 issued to Tchakarov et al. and will be further explained with reference to FIG. 3A.

Figure 3A:
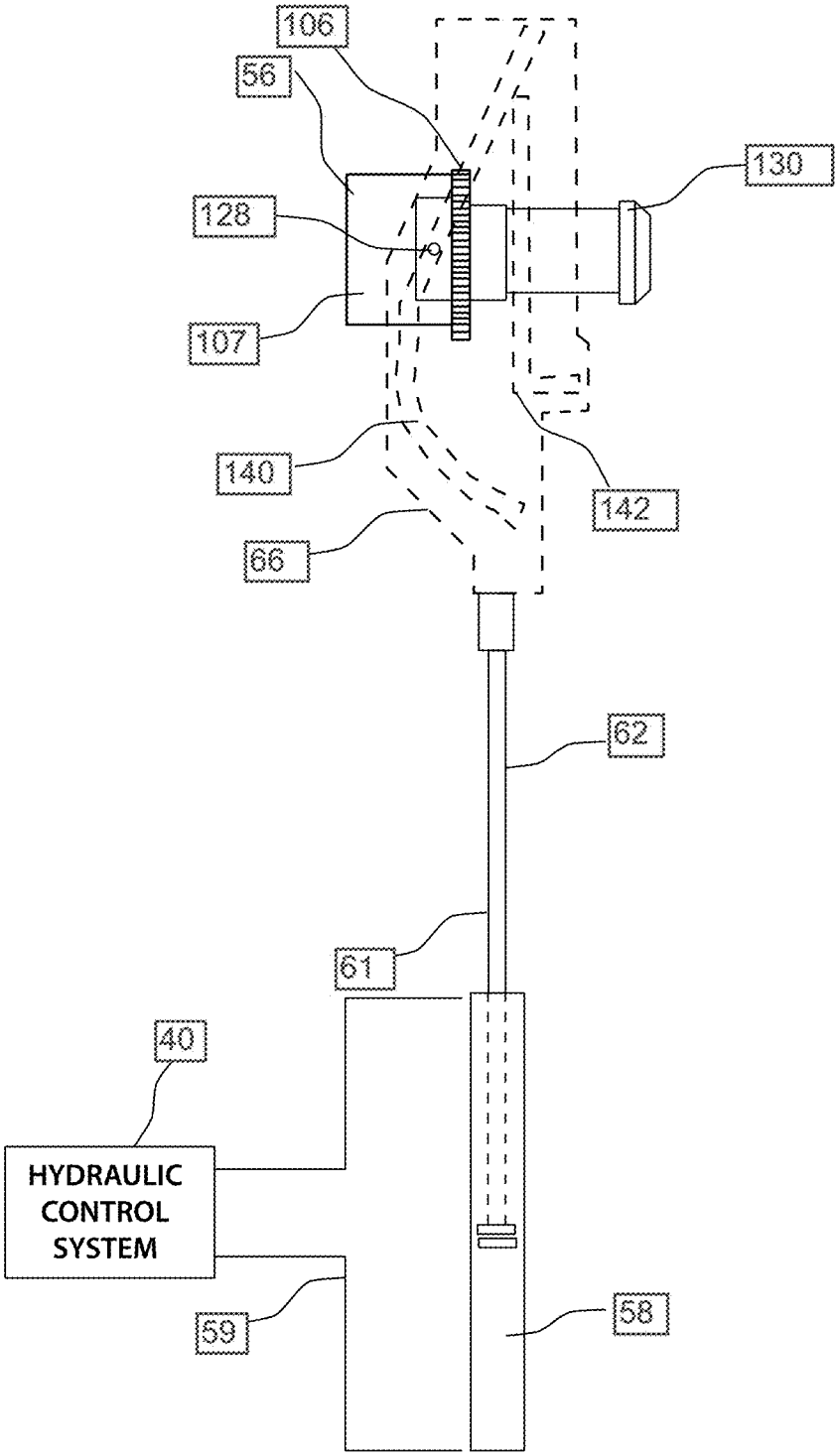
FIG. 3A shows details of an example tubular penetration mechanism.

FIG. 3A shows components of an example embodiment of the power module 5A comprising an hydraulic control system 40 which may include components such as an hydraulic pump and valves operable by control signals communicated from the surface, e.g., using the electrical cable (3 in FIG. 1). The control signals may cause the hydraulic control system 40 to induce hydraulic actuators 58, 62 to urge guide plates 66 upwardly which causes the penetration device 5 to rotate such that a rotary mill or bit 130 is moved outwardly from the housing (1A in FIG. 1) of the penetration device 5. In particular, guide pins 128 on each side of the penetration device 5 may move within cam slots 140, 142. When the hydraulic actuators 58, 62 urge the guide plates 66 to a predetermined extended position, a gear 106 of the transmission assembly 107 is operably coupled to a gear (not shown) on the motor (not shown), for transmitting torque to the gear 106. Further, the guide pins 128 attached to the guide plate 66 urge the penetration device 5 outwardly (to the right in FIG. 3A) such that the rotary mill or bit 130 contacts the tubular (e.g., tubing 2A in FIG. 1). The hydraulic actuators 58, 62 may also be configured, in some embodiments, to enable the penetration device (e.g., 5 in FIG. 3) to be moved longitudinally along the interior of the housing (1A in FIG. 1) so that certain operations requiring longitudinal movement of the penetration device, e.g., milling a window in a wellbore pipe or tubular may be performed. An example of such milling operation will be explained further with reference to FIGS. 16 and 17A through 17F.

For deeper penetration, a telescopic feeding system can be used. Also, the penetration device 5 may be extended at a different angle than illustrated. A depth penetration monitoring and measuring function may be built into the penetrating device 5. An example of the foregoing may include a pressure sensor 59 in fluid communication with a side of the hydraulic control system 40 that is pressurized to extend the penetration device 5 such that an amount of force exerted by the penetration device 5 may be estimated or determined. Further, a linear position sensor 61, such as a linear variable differential transformer (LVDT) may be used to measure an amount of lateral extension of the penetration device 5. Measurements of amount of force and/or lateral extension may be used to enable the user of the wellbore intervention tool to stop operation of the penetration device 5 when the desired tubular has been penetrated. In such manner, penetration of any additional tubulars (e.g., the casing 2B in FIG. 1) disposed externally to the penetrated tubular (e.g., tubing 2A in FIG. 1) may be prevented if such is desired by the wellbore intervention tool operator.

Figure 4:
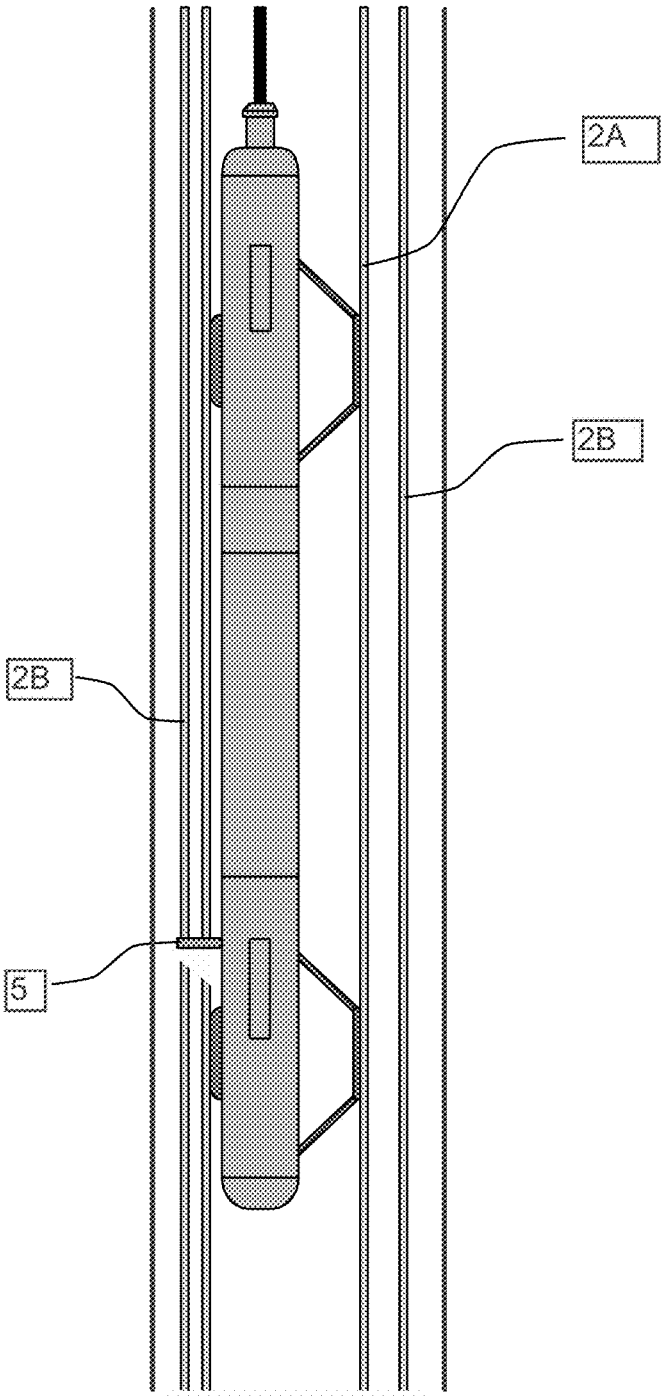
FIG. 4 illustrates penetration of a second wellbore tubular placed externally of a first wellbore tubular.

FIG. 4 illustrates penetration of a second wellbore pipe or tubular 2B, e.g., a casing, placed externally of a first wellbore pipe or tubular 2A, e.g., a tubing nested inside the casing 2B.

Upon completion of the penetration operation, the penetrating device 5 may be retracted back into the housing 1A by reversing operation of the hydraulic control system (40 in FIG. 3A). Thereafter, the laterally extensible arms 4A, 4B may be retracted and the wellbore intervention tool 1 may be moved to a different position in the wellbore (2D in FIG. 1) or removed entirely from the wellbore.

In some embodiments, the penetration device 5 may include a mechanism enabling insertion of a mechanical plug (131 in FIG. 3A) into and secured in place, e.g., by interference fit or by threading, in the penetration to prevent further fluid communication through the penetration (see FIG. 3).

In some embodiments as shown in FIG. 4A, a portion of the housing 1A disposed between the laterally extensible arms 4A, 4B may be rotatable by including swivels 35 in such portion of the housing 1A. A motor 37 may be disposed in a non-rotatable part of the housing 1A so that the rotatable part 1AA, including the penetrating device 5 may be rotated to perform certain operations as will be further explained with reference to FIGS. 16 and 17A through 17F.

Figure 5:
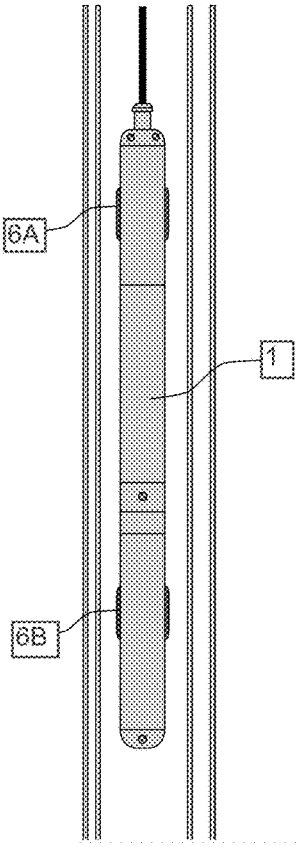
FIG. 5 illustrates a wellbore intervention tool, where the tool is equipped with flexible and expandable centralizers, instead of mechanical arms.

FIG. 5 illustrates another example embodiment wherein the wellbore intervention tool 1 includes radially expandable flexible elements such as centralizer/sealing devices 6A, 6B at spaced apart positions along the housing, instead of mechanical laterally extensible arms as shown in FIGS. 2, 3 and 4. The radially expandable flexible elements 6A, 6B may be hydraulically inflated packer elements, mechanically compressed packer elements or the like. Hydraulically inflatable packers may use an hydraulic control system such as explained with reference to FIG. 3A for inflation and deflation thereof. Mechanically compressed annular sealing elements may use a longitudinal compression mechanism similar in structure to the mechanism used to operate the laterally extensible arms in the embodiments shown in FIGS. 1 through 4.

Figure 6:
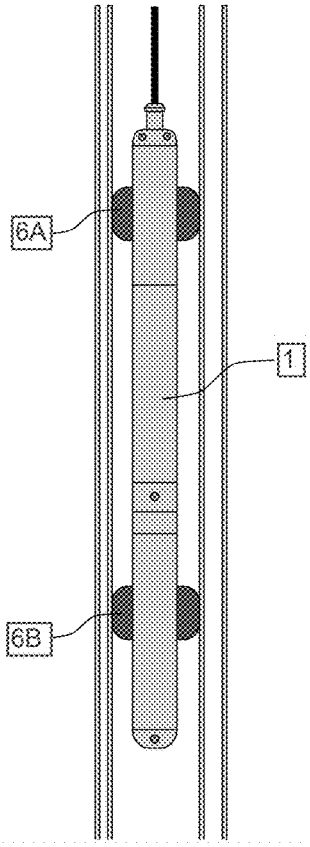
FIG. 6 illustrates the wellbore intervention tool of FIG. 5 with both lower and upper centralizers expanded.

FIG. 6 illustrates the wellbore intervention tool 1 with both lower 6B and upper 6A flexible elements expanded to hydraulically isolate an area therebetween for a planned penetration of the tubular (e.g., tubing 2A).

Figure 7:
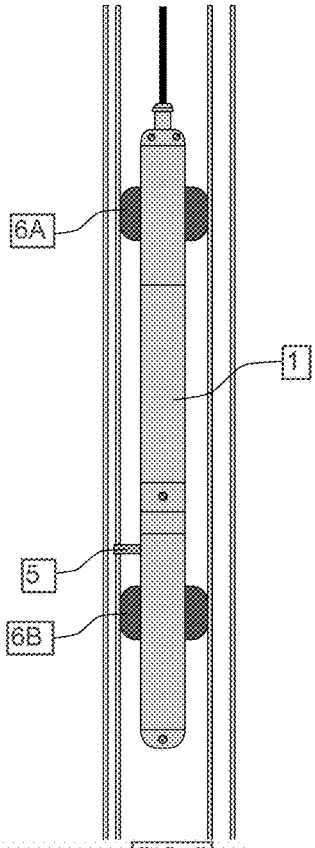
FIG. 7 illustrates the tool FIG. 5 with its penetrating device extended, penetrating a wellbore tubular.

FIG. 7 illustrates the wellbore intervention tool of FIG. 6 with the penetration device 5 extended and penetration completed through a first wellbore tubular 2A. The penetration device 5 may be configured as explained with reference to FIG. 3A in some embodiments.

Figure 8:
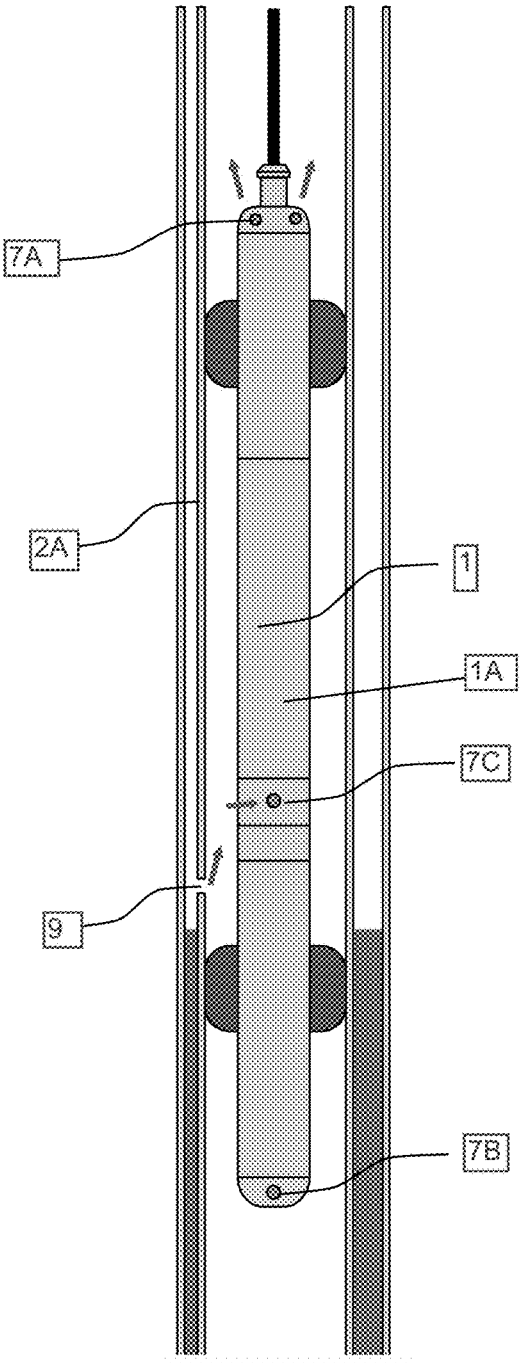
FIG. 8 illustrates the wellbore intervention tool of FIG. 5 with its tubular penetration device retracted, and that fluids are flowing from an area outside the penetrated tubular through the intervention tool toward the surface.

FIG. 8 illustrates the wellbore intervention tool 1 wherein the penetration device (5 in FIG. 7) is retracted, and fluid may flow (shown by arrows) from the area outside the tubular 2A through the penetration 9 and thence through the wellbore intervention tool 1 toward the surface via fluid communication ports 7A, 7C in the housing 1A.

Figure 8A:
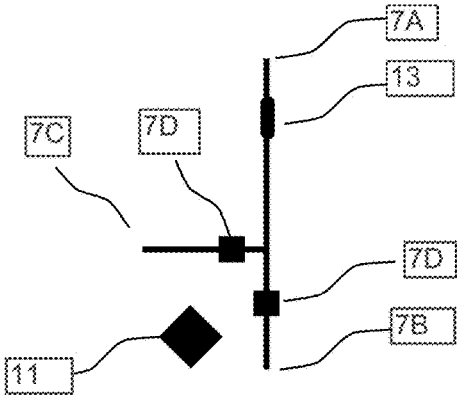
FIG. 8A shows a valve arrangement that may be used in some embodiments as in FIG. 8.

As shown in FIG. 8A, the ports 7A, 7C may be coupled to each other using a controllable valve 7D to provide that fluid flow through the tool housing (1A in FIG. 8) any time be closed off Sensors 11 in hydraulic communication with the ports 7A, 7C may be used to measure pressure variation as a result of opening and/or closing the valves 7D.

In some embodiments, one or more of the sensors 11 may be an acoustic sensor, a temperature sensor, a flow sensor or other sensor capable of detecting movement of fluid external to the housing (1A in FIG. 1), either inside the first wellbore pipe (2A in FIG. 1) or outside the first wellbore pipe.

In some embodiments, a fluid sampling chamber 13 may be incorporated in the wellbore intervention tool or attached as a separate module to the wellbore intervention tool, so that fluids may be sampled and brought to the surface for later analysis. Using the sensors 11 and samples of fluid moved into the chamber 13, the wellbore intervention tool may be used to perform reservoir testing, pressure drawdown and build-up analysis and the like. The embodiment shown in FIG. 8A may also be used such that the chamber 13 stores a sealant such as epoxy resin or cement in fluid form. The sealant may be pumped from the chamber 13 and discharged from the wellbore intervention tool through one or more of the ports, e.g., 7C, so that the sealant may be urged into the penetration (e.g., 9 in FIG. 8) created by the penetrating device (5 in FIG. 7). In this way, fluid sealing in the annular space (2C in FIG. 1) may be established or may be improved.

In some embodiments, and referring to FIG. 8B, the wellbore tool may include at least one motor and pump assembly 15 within the housing (1A in FIG. 8) so that fluid can be pumped from the area between the centralizer/sealing elements (6A, 6B in FIG. 8) to the wellbore above or below the wellbore intervention tool through respective ports 7A (and/or 7B in FIG. 8), 7C. The at least one motor and pump assembly 15 may be selectively coupled at its inlet and at its outlet to any of the ports (7A, 7B, 7C in FIG. 8) using suitable valves (e.g., as shown in FIG. 8A) to enable pressure integrity testing, for example, of a cement barrier or similar sealing element or material placed outside a penetrated tubular. In addition, the wellbore intervention tool may pump fluids from one side to the other side of the axial span sealed by the sealing elements (6A, 6B in FIG. 8) in the wellbore intervention tool, enabling pressure integrity testing of a barrier, e.g., a bridge plug (not shown), disposed in the tubular (e.g., 2A in FIG. 8) below the wellbore intervention tool.

Figure 9:
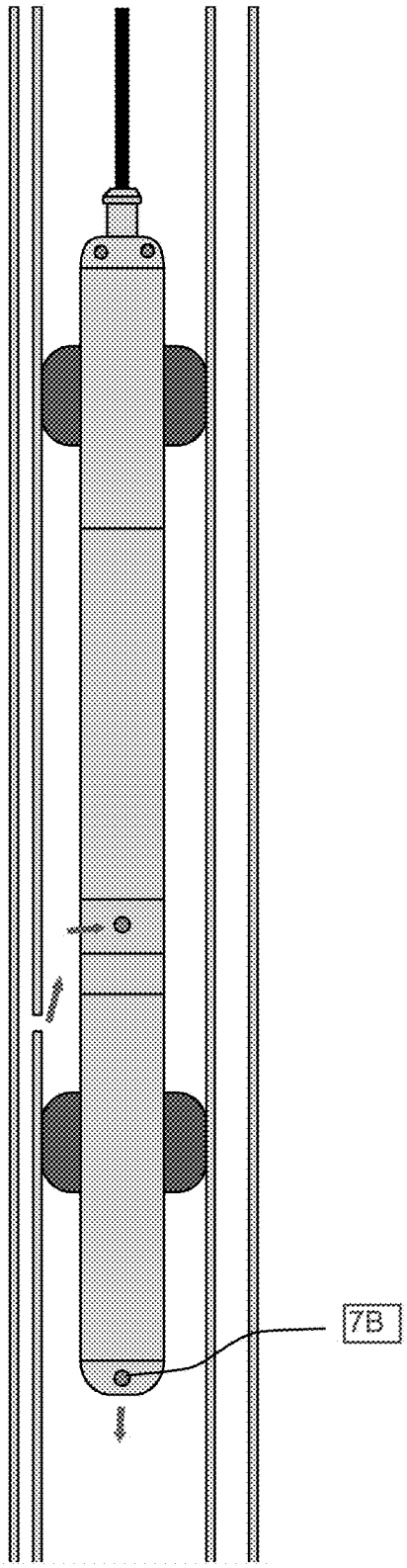
FIG. 9 illustrates the same wellbore intervention tool configuration as in FIG. 8, but with fluid flow discharged from a lower end of the intervention tool.

FIG. 9 illustrates the wellbore intervention tool as in FIG. 8, but with fluid flow discharged from the lower end of the intervention tool through port 7B. Such discharge may be made possible by suitable configuration of valves such as shown in FIG. 8A.

In the embodiments explained with reference to FIGS. 5 through 9, upon completion of the penetration operation, the penetrating device 5 may be retracted back into the tool housing (1A in FIG. 1). Thereafter, the flexible elements 6A, 6B may be retracted and the wellbore intervention tool may be moved with or completely removed from the wellbore.

As previously explained, a mechanism can be built into the wellbore intervention tool so that the wellbore intervention tool can insert a mechanical plug into and secure it in place in the penetration to prevent further fluid communication. Alternatively, the wellbore intervention tool can inject a sealing material into the penetration to secure from leakage the area outside said penetration.

Figure 10:
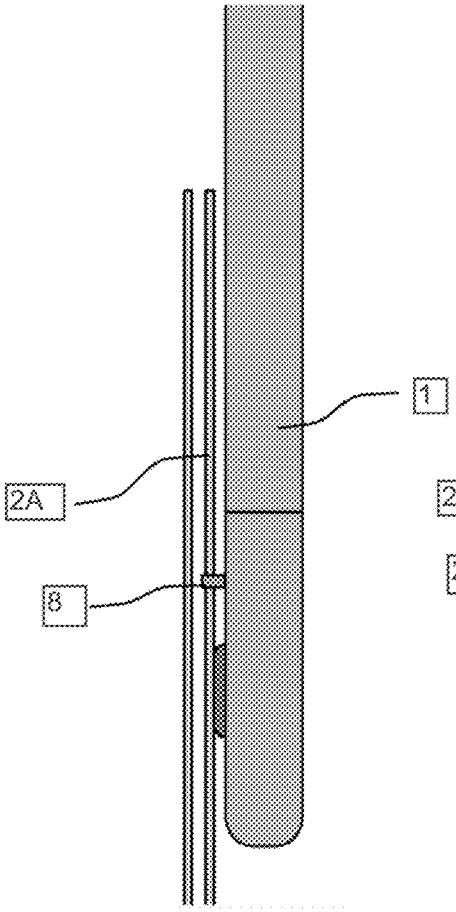
FIG. 10 illustrates a telescopic type penetrating device, having penetrated a first wellbore tubular.

FIG. 10 illustrates another embodiment of a wellbore intervention tool 1 wherein the penetration device may be a telescopic type penetrating device 8. In FIG. 10, the penetration device is shown having penetrated a first tubular 2A proximate the wellbore intervention tool 1.

Figure 11:
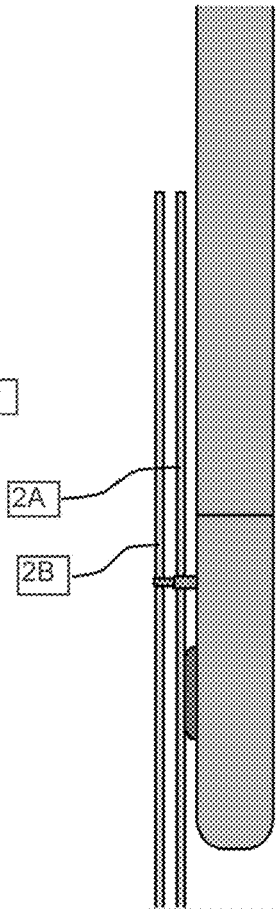
FIG. 11 illustrates a telescopic type penetrating device, having penetrated a second wellbore tubular in which the first tubular of FIG. 10 is nested.

FIG. 11 illustrates the telescopic type penetration device 8 of FIG. 10 wherein the penetration device has penetrated a second tubular 2B disposed externally to the first tubular 2A.

Figure 12:
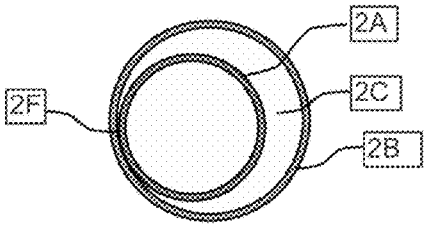
FIG. 12 illustrates typical off-center placements of wellbore tubulars, as for example two casing strings.

FIG. 12 illustrates typical off-center placements of wellbore tubulars 2A, 2B, for example, two nested casing strings or a nested casing string and a tubing string. Placing a sealant material, as for example cement, in the annulus 2C between two such tubulars 2A, 2B completely isolating the area where the two tubular strings are in contact, e.g., as shown at 2F, may be very difficult, resulting in a possible fluid leakage path.

Figure 13:
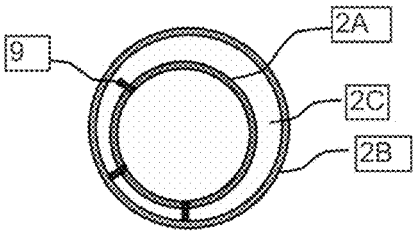
FIG. 13 illustrates the wellbore intervention tool creating several penetrations through a tubular, after which the penetration tool inserts centralizing pins through the penetrations.

FIG. 13 illustrates that the wellbore intervention tool has created several penetrations through an inner nester tubular 2A, whereinafter the wellbore intervention tool 1 may insert centralizing pins 9 through the same penetrations so that the inner nested tubular 2A may be better centralized in the outer nested tubular 2B for following with fluid circulation and placement of a sealing material as cement or similar sealant. The centralizing pins 9 can be designed so that they seal off the respective penetrations, such as by interference fit as well as in a way that the pins 9 will only pass through the penetration as shown in FIG. 13 and not through the outer nester tubular 2B. In some embodiments, the centralizing pins 9 may be threaded, so that rotation of the centralizing pins, e.g., by rotating the rotary bit 130 in FIG. 3A, moves the centralizing pins longitudinally to separate the inner nested tubular from the outer nested tubular.

Figure 14:
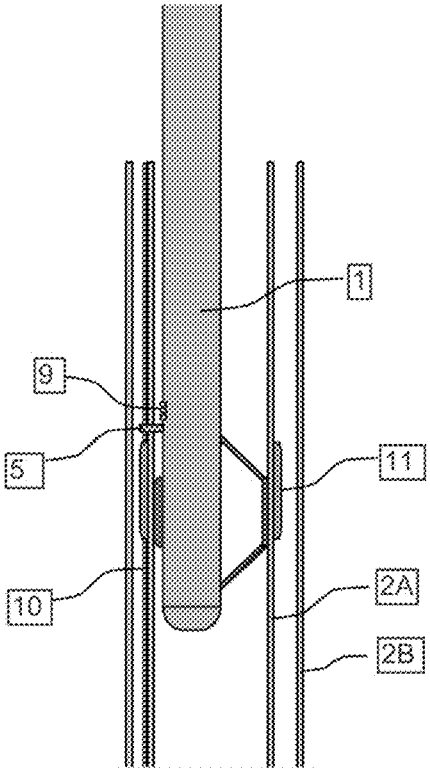
FIG. 14 illustrates cutting of one or several tubulars placed externally on a production or injection tubing.

FIG. 14 illustrates cutting of one or several small diameter tubes 10 placed externally on a production or injection tubing 2A. The tubes 10 may contain electrical/optic instrumentation cable, or they may be hydraulic and/or pneumatic lines connected to devices placed in the wellbore, for example, mounted on the production or injection tubing 2A. Removing these tubes 10 may be required to properly place a barrier such as cement, resin or the like in the annular space (see 2C in FIG. 12) between the tubing 2A and the immediately adjacent outer nesting tubular 2B. An imaging device 19, for example, a video camera with lights, may be implemented in the tool so that the tool operator can control the movement and location of the tool to verify cutting of the tubes 10.

The wellbore intervention tool 1 penetrate the inner nested tubular 2A as well as cutting the external tube(s) 10, for example, by sideways movement. Desirable locations for cutting such external tube(s) 10 may be immediately above and below cable clamps 17 installed on the exterior of the inner nested tubular 2A (e.g., prodiction tubing) when the same is installed in the wellbore.

Figure 15:
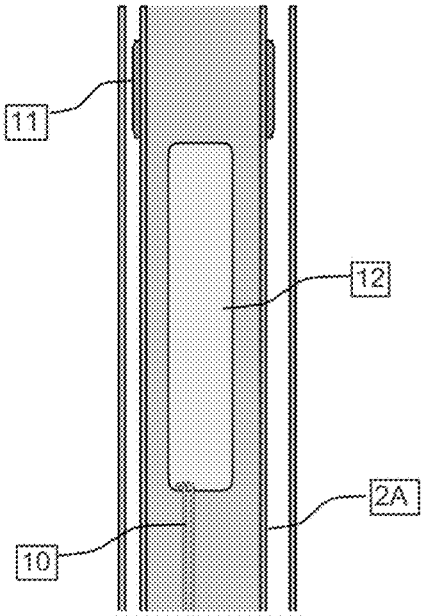
FIG. 15 illustrates a "window" cut in a tubing string, where several micro tubes have been cut and pulled into the tubing through the window.

FIG. 15 illustrates a "window" 12 cut in a tubing string 2A, where several tubes 10 have been cut and pulled into the interior of the tubing string 2A. The tubes 10 may fall naturally into the window 12 opened when the tubes 10 are cut at the upper end of the window 12, or a micro gripper can be adapted to the wellbore intervention tool to pull the tubes 10 into the interior of the tubing string 2A after cutting the tubes 10. Now a section of the tubing string 2A is free from any external tubes, and a barrier may be placed in the window area without any tubes penetrating the barrier.

Figure 16:
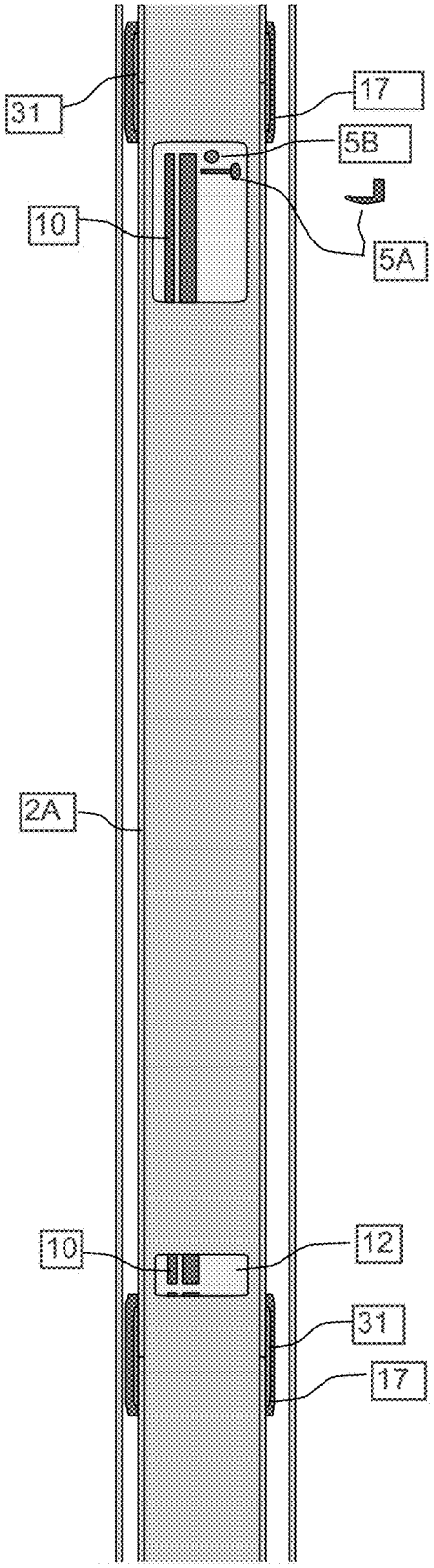
FIG. 16 illustrates elements of the procedure described with reference to FIG. 15 in more detail.

FIG. 16 illustrates elements of the procedure described with reference to FIG. 15 in more detail. FIG. 16 illustrates how windows 12 can be cut in a tubing 2A and how external tubes 10 may be cut. For example, immediately above a tubing coupling 31 (which may be an external collar threaded to adjacent segments of tubing or may be a pin and box connection as used in other types of wellbore tubulars such as drill pipe), and as close to above the upper end of an externally mounted line clamp 17, a mill 5B which may be part of the penetrating device (5 in FIG. 14) penetrates the tubing 2A and may cut a window 12 in the tubing 2A. The mill 5B may then cut the external tubes 10. The mill 5B may be extended, operated, moved and retracted using a mechanism such as described with reference to FIG. 3A. Milling the window 12 may include rotation of the direction of the mill about the circumference of the tubing 2A. Such rotation may be obtained using a configuration of the wellbore intervention tool that includes swivels and a motor as explained with reference to FIG. 4.

Thereafter, the entire tool may be moved upwardly in the tubing 2A until it is positioned proximately below the lower end of the next line clamp 17. Then another window 12 may be created in the tubing 2A without extending the mill 5B laterally far enough to cut the external tubes 10.

Following the foregoing procedure, a tube gripping and retracting device 5A such as a claw may be extended through the window 12 beside the tubes 10. The claw 5A may be extended and retracted using a mechanism such as shown in and explained with reference to FIG. 3A may be extended so that the tubing is pushed away from the external tubular. Then the claw 5A may be rotated until it is located externally to the tubes 10, whereafter the claw 5A may be is retracted toward the intervention tool, holding the tubes 10 locked towards the intervention tool. Then the mill 5A may be extended to an area between the claw 5B and the lower end of the line clamp 17 to a depth sufficient to cut the tubes 10. The milling tool 5B may then be rotated until all the tubes 10 are cut.

After all the tubes 10 are cut, the intervention tool may be released from its locked position in the tubing 2A, where lifting the tool upwardly pulls the tubes 10 into tubing 2A through the upper window 17. Now the intervention tool may be used to lift the tubes 10 to the surface, or drop the tubes 10 into the tubing 2A. This sequence of operations may enable proper placement of barrier material, as for example cement, outside as well as inside the tubing 2A.

Figure 17A:
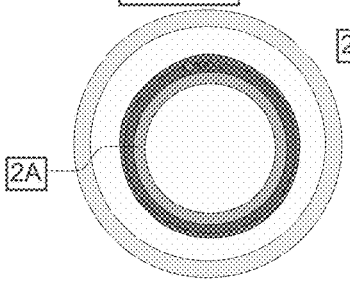
FIGS. 17A through 17F show a cross section of the operations performed as explained with reference to FIG. 16.
Figure 17B:
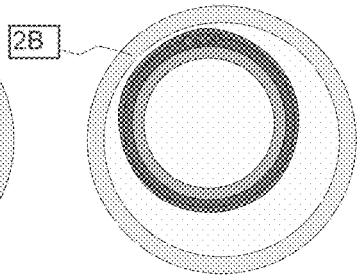
Figure 17C:
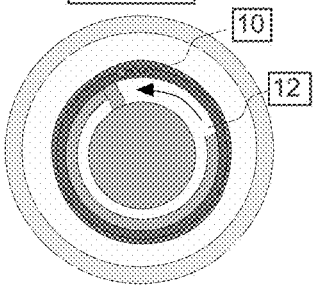
Figure 17D:
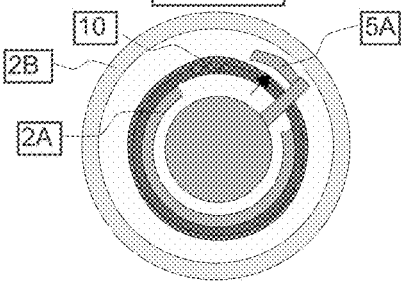
Figure 17E:
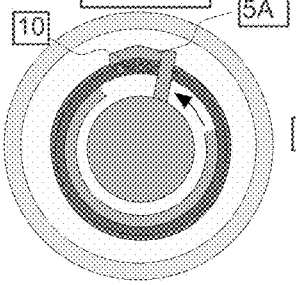
Figure 17F:
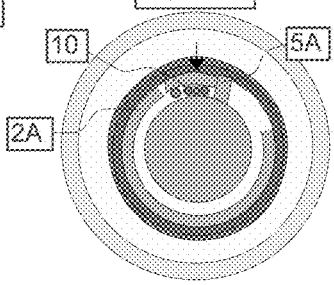

The foregoing sequence of operations is shown in cross section in FIGS. 17A through 17F. Above sketches illustrates upper window cutting and micro tube retrieval operation described on previous drawing, where:

FIG. 17A shows a tubing string 2A with a cross coupling cable protector (or cable clamp —17 in FIG. 16) holds micro tubes externally of same tubing string. This is located within a casing. In FIG. 17B the tubing 2A may lay longitudinally against a casing 2B external to the tubing 2A. In FIG. 17C, a window 12 is cut, without cutting the tubes 10. In FIG. 17D, a claw 5A is extended from the wellbore intervention tool until it is located so that it may be rotated between the tubes 10 and the casing 2B. If the tubing 2A is laying against the casing 2A as illustrated, the claw 5A will also lift the tubing 2A away from the casing 2B, allowing the claw 5A to rotate. In FIG. 17D, the claw 5A is rotated until all the tubes 10 are within reach of the claw 5A. In FIG. 5E the claw 5A is retracted to the wellbore intervention tool, at same time bringing micro tubes into contact with the intervention tool. Now the tubes 10 may be cut above the claw 5A and the tubes 10 pulled into the tubing 2A as shown in FIG. 17F.

Figure 18:
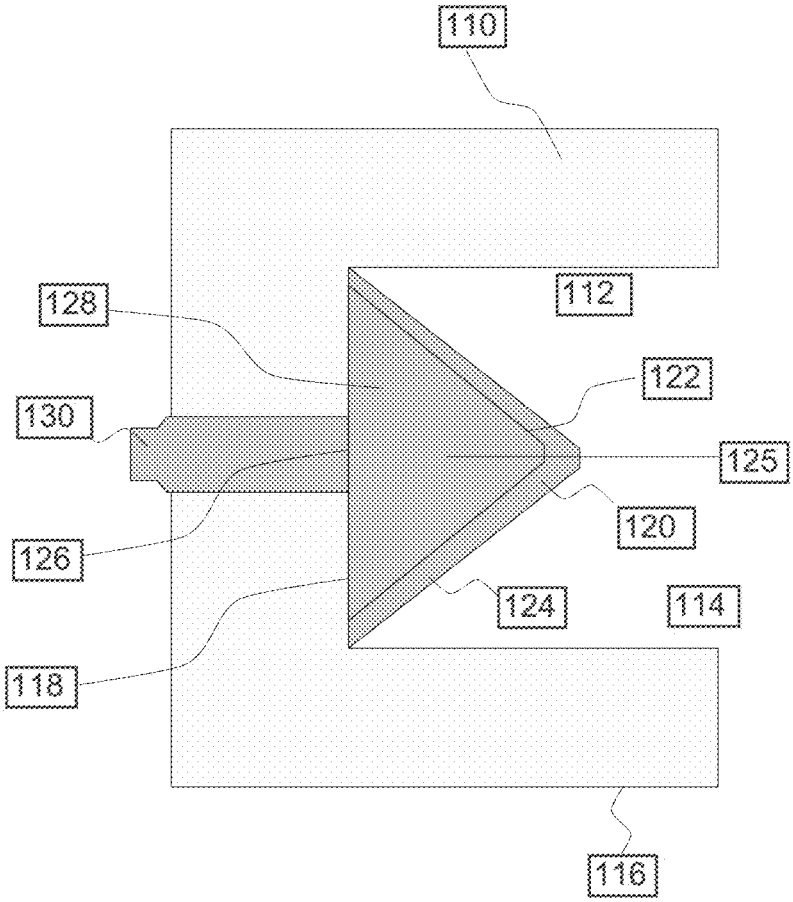
FIG. 18 shows an example shaped explosive charge that may be used in some embodiments.

In some embodiments, the penetrating device may include, in addition to the mechanism explained with reference to FIG. 3A, one or more shaped explosive charges disposed in the housing (1A in FIG. 1) and selectably detonatable to create the penetration (e.g., shown at 9 in FIG. 9). An example embodiment of a shaped charge is shown in FIG. 18, and is described in more detail in U.S. Pat. No. 5,733,850 issued to Chowla et al. A charge case 110 defines a recessed cavity 112 having open end 114, a casing wall 116, and a closed end 118. If the cavity 112 of the charge case 110 has a parabolic or elliptical shape, the casing wall 116 and the closed end 118 are collectively defined by a continuous curved surface. A liner 120 forms a geometric figure having a liner apex 122 and a liner base 124 symmetrically formed about a longitudinal axis 125. The liner 120 is positioned within the cavity 112 so that the liner apex 122 faces the closed end 118. The liner base 124 faces toward the open end 114. The liner 20 defines a interior volume or hollow space 126 between the liner base 124 and the liner apex 122. High explosive material 128 is positioned between the casing wall 116 and the liner 120, and a spoiler 130 may be positioned within the hollow space 126.

A detonator (not shown) comprises a primer or detonator cord suitable for igniting the high explosive material 128 to generate a detonation wave. Such detonation wave focuses the liner 120 to collapse toward the longitudinal axis 125 and to form a material perforating jet. As the collapsing liner 120 moves towards the open end 114, the jet also moves in such direction consistent with the law of momentum conservation. The jet exits case 110 at high velocity and is directed toward the selected target, i.e., the one or more tubulars such as shown in FIG. 1. Although the liner 120 is preferably metallic, the liner 120 can be formed with any material suitable for forming a high velocity perforating jet. The spoiler 130 is illustrated as a member positioned within the hollow space 126. As shown, the spoiler 130 is preferably located proximate to the liner apex 122 and is symmetric about the longitudinal axis 125. The spoiler 30 defocuses the jet by interrupting or retarding the normal collapse of the liner 120 and resisting the collapse of the liner 120 along the longitudinal axis 125. As the detonation wave focuses the liner 120 to collapse inwardly, the spoiler 130 retards such collapse so that the liner 120 forms a toroidal or annular jet which exits the open end 114. The foregoing example shaped charge may be particularly suited for penetrating tubulars without necessarily penetrating deeply into formations surrounding the exterior of the outermost nested tubular where the wellbore intervention tool is used inside nested tubulars. However, the foregoing example of a shaped charge is not intended to limit the scope of the present disclosure. Other types of shaped explosive charges known in the art may be used in other embodiments.

Figure 8B:
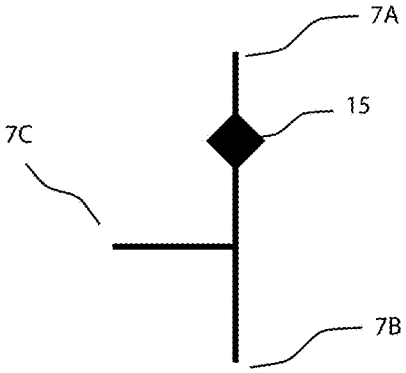
FIG. 8B shows an example fluid pump and motor assembly that may be used in some embodiments.

In other embodiments, the penetrating device (e.g., as shown at 5 in FIG. 3) may comprise a plasma cutting device, a fluid cutting jet (e.g., with or without abrasive particles such as may be operated by the motor and pump assembly shown in FIG. 8B), an electrode discharge machining (EDM) cutter or laser.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A wellbore intervention tool, comprising:

a housing;

means for locking the housing at a selected position inside a first wellbore pipe;

means for penetrating the first wellbore pipe extensible from the housing, the means for penetrating comprising means for measuring an amount of extension thereof or means for measuring an amount of force exerted thereby such that the means for penetrating is controllable to penetrate the first wellbore pipe without penetration of a second wellbore pipe in which the first wellbore pipe is nested;

at least two swivels disposed at spaced apart locations along the housing and a motor disposed in part of the housing wherein a portion of the housing disposed between the at least two swivels is rotatable with respect to a rotationally fixed portion of the housing; and a gripping and retracting device extensible from the housing and configured to retract lines disposed externally to the first wellbore pipe through an opening cut in the first wellbore pipe by the means for penetrating.

2. The wellbore intervention tool of claim 1 wherein the means for locking comprises at least one laterally extensible arm.

3. The wellbore intervention tool of claim 1 wherein the means for locking comprises at least one radially expandable annular flexible element.

4. The wellbore intervention tool of claim 3 wherein at least one radially expandable annular flexible element comprises a first inflatable packer.

5. The wellbore intervention tool of claim 4 further comprising ports in the housing disposed longitudinally outside a longitudinal zone defined by the first inflatable packer and a second, longitudinally spaced apart inflatable packer, the ports coupled to valves operable to selectively establish fluid communication between longitudinal zones defined by the first and second inflatable packers.

6. The wellbore intervention tool of claim 5 wherein at least one of the zones is inside the longitudinal zone and at least one of the zones is outside the longitudinal zone whereby fluid is movable by the at least one pump between the defined longitudinal zones.

7. The wellbore intervention tool of claim 5 further comprising a pressure sensor selectably connectible in fluid communication with at least one of the ports.

8. The wellbore intervention tool of claim 1 wherein the means for penetrating comprises a mill.

9. The wellbore intervention tool of claim 1 wherein the means for penetrating comprises at least one of a fluid cutting jet, a plasma cutter, an electrode discharge machining cutter and a laser.

10. The wellbore intervention tool of claim 1 further comprising means for inserting a plug in a penetration created in the first wellbore pipe by the means for penetrating.

11. The wellbore intervention tool of claim 10 wherein the plug comprises a threaded pin.

12. The wellbore intervention tool of claim 1 further comprising means for inserting a pin in a penetration created in the first wellbore pipe by the means for penetrating.

13. The wellbore intervention tool of claim 12 wherein the means for inserting a pin comprises means for urging the pin into contact with an interior wall of the second wellbore pipe so as to separate the first wellbore pipe from contact with the second wellbore pipe.

14. The wellbore intervention tool of claim 1 further comprising at least one imaging device arranged to generate images corresponding to an area proximate the means for penetrating.

15. The wellbore intervention tool of claim 1 further comprising a fluid chamber selectively fluidly connectible to the means for penetrating such that fluid samples are collectible from a penetration in the first wellbore pipe created by the means for penetrating.

16. The wellbore intervention tool of claim 1 further comprising a fluid chamber selectively fluidly connectible to the means for penetrating such that sealant is dischargeable from the chamber into a selected space in at least one of the first wellbore pipe and the second wellbore pipe.

17. The wellbore intervention tool of claim 1 wherein the means for penetrating comprises at least one shaped explosive charge.

18. The wellbore intervention tool of claim 1 further comprising a means for moving the means for penetrating longitudinally along the housing.

19. The wellbore intervention tool of claim 1 further comprising at least one sensor sensitive to fluid movement outside the housing.

20. The wellbore intervention tool of claim 19 wherein the at least one sensor comprises at least one of an acoustic sensor, a temperature sensor and a flow sensor.

21. A method for wellbore intervention comprising:

moving a wellbore intervention tool to a selected position inside a first wellbore pipe nested within a second wellbore pipe;

locking the wellbore intervention tool at the selected position;

cutting at least one opening in the first wellbore pipe;

performing at least one intervention operation using the at least one opening in the first wellbore pipe;

removing the wellbore intervention tool and the retrieved tube from the first wellbore pipe;

cutting at least one line mounted to an exterior of the first wellbore pipe; and withdrawing the at least one line into an interior of the first wellbore pipe, and withdrawing the at least one line and the wellbore intervention tool from the first wellbore pipe.

22. The method of claim 21 wherein the cutting at least one opening comprises milling.

23. The method of claim 21 wherein the at least one intervention operation comprises withdrawing fluid through the at least one opening.

24. The method of claim 21 wherein the at least one intervention operation comprises pressure testing the first wellbore pipe.

25. The method of claim 21 wherein the at least one intervention operation comprises moving fluid through a longitudinal zone defined by actuating longitudinally spaced apart sealing elements extended from the wellbore intervention tool.

26. The method of claim 21 wherein the at least one intervention operation comprises inserting a pin into the at least one opening.

27. The method of claim 26 wherein the inserting the at least one pin is performed so as to move the second wellbore pipe out of contact with the first wellbore pipe.

28. The method of claim 21 wherein the at least one intervention operation comprises pressure integrity testing at least one of the first wellbore pipe and the second wellbore pipe.

* * * * *